US007512523B2

(12) United States Patent
Johnson et al.

(10) Patent No.: US 7,512,523 B2
(45) Date of Patent: Mar. 31, 2009

(54) REFRIGERANT LOSS TRACKING AND REPAIR

(75) Inventors: Daniel T. Johnson, Wayzata, MN (US); James W. Peterson, Lake Elmo, MN (US); Robert S. McConnell, Woodbury, MN (US)

(73) Assignee: Verisae, Inc., Minneapolis, MN (US)

( * ) Notice: Subject to any disclaimer, the term of this patent is extended or adjusted under 35 U.S.C. 154(b) by 609 days.

(21) Appl. No.: 10/429,619

(22) Filed: May 5, 2003

(65) Prior Publication Data

US 2004/0111697 A1 Jun. 10, 2004
US 2007/0277147 A9 Nov. 29, 2007

Related U.S. Application Data

(63) Continuation-in-part of application No. 09/883,779, filed on Jun. 18, 2001.

(60) Provisional application No. 60/432,120, filed on Dec. 9, 2002.

(51) Int. Cl.
*G06F 15/00* (2006.01)

(52) U.S. Cl. ..... 702/188

(58) Field of Classification Search ..... 702/45, 702/50, 51, 59, 62, 80, 82, 98, 99, 100, 138, 702/182, 183–185, 188; 62/77, 129; 709/203
See application file for complete search history.

(56) References Cited

U.S. PATENT DOCUMENTS 4,612,620 A 9/1986 Davis et al.
4,688,026 A 8/1987 Scribner et al.
4,755,957 A * 7/1988 White et al. ..... 702/184
4,989,141 A 1/1991 Lyons et al.
5,079,930 A * 1/1992 Beaverson et al. ..... 62/129
5,198,774 A * 3/1993 Williams et al. ..... 324/468
5,231,841 A * 8/1993 McClelland et al. ..... 62/77
5,434,775 A 7/1995 Sims et al.
5,537,313 A 7/1996 Pirelli
5,572,438 A 11/1996 Ehlers et al.
5,732,401 A 3/1998 Conway
5,748,956 A 5/1998 Lafer et al.
5,752,244 A 5/1998 Rose et al.
5,758,126 A 5/1998 Daniels
5,821,937 A 10/1998 Tonielli (Continued)

FOREIGN PATENT DOCUMENTS

EP 1566875 8/2005

(Continued)

OTHER PUBLICATIONS

EPA, Equipment Containing Ozone Depleting Substances at Industrial Bakeries, Feb. 2, 2002, vol. 67, pp.1-27.*

(Continued)

*Primary Examiner*—Edward Raymond
*Assistant Examiner*—Mohamed Charioui
(74) *Attorney, Agent, or Firm*—Faegre & Benson LLP

(57) ABSTRACT

A system and method for asset management including tracking refrigerant characteristics is disclosed. The system includes a database including information relating to a refrigerant system and a database including information relating to service technicians. A server is programmed to track a refrigerant characteristic and to provide notifications to a user relating to the refrigerant characteristic.

24 Claims, 13 Drawing Sheets

U.S. PATENT DOCUMENTS

| | | | | |
|---|---|---|---|---|
| 5,831,610 | A | 11/1998 | Tonielli | |
| 5,845,265 | A | 12/1998 | Woolston | |
| 5,859,778 | A | 1/1999 | Ichiro et al. | |
| 5,860,286 | A * | 1/1999 | Tulpule | 62/129 |
| 5,910,776 | A | 6/1999 | Black | |
| 5,918,207 | A | 6/1999 | McGovern et al. | |
| 5,923,850 | A | 7/1999 | Barroux | |
| 5,944,662 | A | 8/1999 | Schoendorfer | |
| 5,946,662 | A | 8/1999 | Ettl et al. | |
| 5,956,658 | A | 9/1999 | McMahon | |
| 5,980,090 | A | 11/1999 | Royal, Jr. | |
| 5,987,903 | A * | 11/1999 | Bathla | 62/129 |
| 5,996,889 | A | 12/1999 | Fuchs et al. | |
| 6,128,602 | A | 10/2000 | Northington et al. | |
| 6,154,738 | A | 11/2000 | Call | |
| 6,169,979 | B1 | 1/2001 | Johnson | |
| 6,211,782 | B1 * | 4/2001 | Sandelman et al. | 340/506 |
| 6,293,114 | B1 * | 9/2001 | Kamemoto | 62/129 |
| 6,298,333 | B1 | 10/2001 | Manzi et al. | |
| 6,385,510 | B1 | 5/2002 | Hoog et al. | |
| 6,430,542 | B1 | 8/2002 | Moran | |
| 6,437,692 | B1 | 8/2002 | Petite et al. | |
| 6,650,346 | B1 | 11/2003 | Jaeger et al. | |
| 6,892,546 | B2 | 5/2005 | Singh et al. | |
| 6,952,680 | B1 | 10/2005 | Melby et al. | |
| 7,062,389 | B2 | 6/2006 | Johnson et al. | |
| 7,062,446 | B1 | 6/2006 | Suhy, Jr. et al. | |
| 7,142,949 | B2 | 11/2006 | Brewster et al. | |
| 7,149,701 | B2 | 12/2006 | McKinney | |
| 7,196,621 | B2 | 3/2007 | Kochis | |
| 7,259,675 | B2 | 8/2007 | Baker et al. | |
| 7,304,573 | B2 | 12/2007 | Postma | |
| 7,333,880 | B2 | 2/2008 | Brewster et al. | |
| 7,369,968 | B2 | 5/2008 | Johnson et al. | |
| 2001/0047383 | A1 | 11/2001 | Dutta | |
| 2002/0016757 | A1 | 2/2002 | Johnson et al. | |
| 2002/0059364 | A1 * | 5/2002 | Coulthard et al. | 709/203 |
| 2002/0070971 | A1 | 6/2002 | Brown et al. | |
| 2002/1383861 | | 9/2002 | Sy-Yuan | |
| 2003/0154141 | A1 | 8/2003 | Capazario et al. | |
| 2004/0024662 | A1 | 2/2004 | Gray et al. | |
| 2004/0078306 | A1 | 4/2004 | Whiteley et al. | |
| 2004/0111697 | A1 | 6/2004 | Johnson et al. | |
| 2004/0162642 | A1 | 8/2004 | Gasper et al. | |
| 2004/0193449 | A1 | 9/2004 | Wildman et al. | |
| 2004/0225676 | A1 | 11/2004 | Johnson et al. | |
| 2005/0021710 | A1 | 1/2005 | Johnson et al. | |
| 2005/0086163 | A1 | 4/2005 | Johnson et al. | |
| 2005/0248454 | A1 | 11/2005 | Hanson et al. | |
| 2006/0142961 | A1 | 6/2006 | Johnson et al. | |
| 2006/0170889 | A1 | 8/2006 | Honda | |
| 2006/0256308 | A1 | 11/2006 | Honda | |
| 2007/0043538 | A1 | 2/2007 | Johnson et al. | |
| 2007/0096899 | A1 | 5/2007 | Johnson et al. | |
| 2007/0260405 | A1 | 11/2007 | McConnell et al. | |
| 2007/0268138 | A1 | 11/2007 | Chung et al. | |

FOREIGN PATENT DOCUMENTS

| | | |
|---|---|---|
| JP | 9941717 | 2/1998 |
| JP | 10340846 | 12/1998 |
| JP | 2004-301825 | 10/2004 |
| WO | WO99/66436 A1 | 12/1999 |
| WO | 200017984 | 3/2000 |
| WO | WO 01/97146 | 12/2001 |
| WO | 200207365 | 1/2002 |
| WO | WO 02/090914 | 11/2002 |
| WO | 2005048328 | 5/2005 |
| WO | 2005062351 | 7/2005 |

OTHER PUBLICATIONS

Mr. K. Quinn Hart, Air force refrigerant management program Refrerant management Handbook, Jun. 1994, Air Force Civil Engineer Support Agency, Entire document.*

The Chemical Manufactures Association & The Environmental Protection Agency (EPA): "Compliance Guidance for Industrial Process Refrigeration Leak Repair Regulations Under Section 608 of the Clean Air Act", Oct. 1995 (29pgs).

Chemalliance: "Developing an EPA Refrigerant Regulations Compliance Program", Mar. 29, 2002 (1pg).

"Compliance Guidance for Industrial Process Refrigeration Leak Repair Regulations Under Section 608 of The Clean Air Act", The Chemical Manufactures Association and The Environmental Protection Agency, (1995).

Dilger, Karen Abramic, Asset managment, maintenance redefined, Manufacturing Systems, v15n7,pp. 122-128, Jul. 1997, Coden:Masyes<ISSN: 0748-948x, jrnl code: mfs, Dialog file 15. Accession No. 01493159.

Pays, P. et al., An intermediation and payment system technology, *Computer Networks and ISDN Systems*, North Holland Publishing, Amsterdam, NL, vol. 28, No.11, May 1996, pp. 1197-1206, ISSN: 0169-7552.

Johnson, "Developing an EPA Refrigerant Regulations Compliance Program" Environmental Support Solutions, Mesa, AZ 1999, 6pp.

Terplan, "Web-based Systems and Network Management," CRC Press, pp. 1-43, 1999.I.

European Office Action from European app. 01 948 454.2-2221, dated Mar. 26, 2008, from Examiner C. Diaz de Lezana.

International Search Report, for related case, WO/2004/055608, dated Nov. 18, 2004, 4pgs.

International Preliminary Report on Patentability (IPER), for related case, PCT/US03/39517, dated Mar. 29, 2005., 7pgs.

Office Action received in related case, U.S. Appl. No. 09/883,799, dated Jan. 27, 2005. 8pgs.

Applicant Response to Office Action dated Jan. 27, 2005, in related case, U.S. Appl. No. 09/883,779, filed Jul. 1, 2005, 31 pgs.

Office Action received in related case, U.S. Appl. No. 09/883,779, dated Sep. 26, 2005. 7pgs.

Applicant Response to Office Action dated Sep. 26, 2005, for related case, U.S. Appl. No. 09/883,779, filed Dec. 27, 2005. 9pgs.

Office Action received in related case U.S. Appl. No. 09/883,779, dated Feb. 10, 2006., 14 pgs.

Applicant Response to Office Action dated Feb. 10, 2006, in related Case U.S. Appl. No. 09/883,779, filed May 12, 2006. 16pgs.

Office Action received in related case U.S. Appl. No. 09/883,779, dated Jul. 17, 2006. 18 pgs.

Applicant Response to Office Action dated Jul. 17, 2006, in related case U.S. Appl. No. 09/883,779, filed Oct. 27, 2006, 11 pgs.

Office Action received in related case, U.S. Appl. No. 09/883,779, dated Dec. 14, 2006, 18 pgs.

Applicant Response to Office Action dated Dec. 14, 2006, in related case U.S. Appl. No. 09/883,779, Filed Apr. 16, 2007. 31 pgs.

Advisory Action received in related case, U.S. Appl. No. 09/883,779, dated May 25, 2007, 4pgs.

RCE filed in related case in response to May 25, 2007 Advisory Action, U.S. Appl. No. 09/883,779, filed Jan. 4, 2008, 14 pgs.

Office Action received in related case U.S. Appl. No. 09/883,779 dated Jul. 5, 2007, 13 pgs.

Applicant Response to Office Action dated Jul. 5, 2007, for related case, U.S. Appl. No. 09/883,779, filed Jan. 4, 2008, 14 pgs.

Office Action received in related case, U.S. Appl. No. 09/883,779, dated Apr. 23, 2008, 20 pgs.

Applicant Response to Office Action dated Apr. 23, 2008, for related case, U.S. Appl. No. 09/883,779, filed Aug. 27, 2008. 19 pgs.

Examiner Interview Summary, in related case, U.S. Appl. No. 09/883,779, dated Aug. 29, 2008, 2 pgs.

Office Action received in related case, U.S. Appl. No. 11/431,147, dated May 9, 2008, 8 pgs.

Applicant Response to May 9, 2008, Office Action, in related case, U.S. Appl. No. 11/431,147, filed AUg. 11, 2008, 62 pgs.

Office Action received in reltaed case, U.S. Appl. No. 10/768,957, dated Jun. 30, 2005. 5 pgs.
Applicant Response to Jun. 30, 2005, Office Action, in related case, U.S. Appl. No. 10/768,957, filed Oct. 27, 2005; recorded Oct. 31, 2005, 11 pgs.
Office Action received in related case, U.S. Appl. No. 11/357,330, dated Nov. 17, 2006. 6 pgs.
Office Action received in related case, U.S. Appl. No. 11/423,860, dated Jun. 18, 2007. 6 pgs.
Applicant Response to Jun. 18, 2007, Office Action, for related case U.S. Appl. No. 11/423,860, filed Nov. 21, 2007. 18 pgs.
Australian Application No. 20003296444, Examination Report dated Jun. 24, 2008 Examiner Shu-Yen LEE. 3 pgs.
International Search Report and Written Opinion, for related case, PCT/US07/68420, mail date Sep. 29, 2008, 10 pgs.
Terplan, Kornel. Web-Based Systems and Network Management. ISBN 0-8493-9598-4-9000, CRC Press, 1999. pp. 1-43.
European Patent Office Action, in related case, 04781780.4-2221 PCT/US2004027165 dated May 12, 2006., 2 pgs.
European Patent Office Action, in related case, 04781780.4-2221, dated Nov. 20, 2006, 2 pgs.
Response to European Patent Office Action, for related case, 04781780.4-2221, dated May 25, 2007. 13 pgs.
International Search Report, in related case, PCT/US01/19491, mailing date, Nov. 23, 2001. 3 pgs.
Written Opinion in related case. PCT/US01/19491, mailing date Jun. 11, 2002. 4 pgs.
Response to Written Opinion, in related case, PCT/US01/19491, mailing date Sep. 12, 2002. 12 pgs.
International Preliminary Examination Report, in related case, PCT/US01/19491, mailing date Dec. 13, 2002, 9 pgs.
Written Opinion, in related case, PCT/US04/03008, mailing date Sep. 15, 2005. 9 pgs.
International Search Report and Written Opinion, in related case, PCT/US07/68420, mailing date, Sep. 29, 2008, 10 pgs.
International Preliminary Report, in related case, PCt/US04/027165, mailing date Mar. 2, 2006, 7 pgs.
"Compliance Guidance for Industrial Process Refrigeration Leak Repair Regulations Under Section 608 of The Clean Air Act", The Chemical Manufactures Association and The Environmental Protection Agency, (1995).
"The Greenhouse Gas Protocol: A Corporate Accouting and Reporting Standard," World Resources Institute, 114 pp. Mar. 2004.
European Search Report from European Patent Application No. 07252399.6, dated Sep. 20, 2007, 7 pp.
International Search Report for published application No. WO2004053772 (app. PCT/US2003/039251), republished on Aug. 26, 2004, 3 pp.
International Preliminary Examination Report of intenational application No. PCT/US2003/039251. completed May 3, 2005, 9 pp.
Written Opinion of international application No. PCT/US2003/039251, mailed Sep. 15, 2004, 5 pp.
International Search Report, mailed Nov. 23, 2001, and Written Opinion, mailed Jun. 11, 2002, for international application No. PCT/US2001/019491, 9 pp.
International Search Report and Written Opinion for international application PCT/US2004/027165, filed Aug. 20, 2004, both mailed Feb. 21, 2005, 10 pp.
International Preliminary Examination Report for international application No. PCT/US2003/039517, filed Dec. 12, 2003, completed Mar. 29, 2005, 7 pp.
International Search Report, mailed Nov. 2, 2004, and Written Opinion, mailed Oct. 15, 2004, for international application No. PCT/US2003/039517. 13 pp.
International Preliminary Examination Report of International application No. PCT/US2001/019491, completed Dec. 1, 2002, 9 pp.
International Preliminary Examination Report (with written opinion) of International application No. PCT/US2004/027165, issued Feb. 21, 2006, 7 pp.

* cited by examiner

Enterprise Refrigerant Manager

SUMMARY > RECORD NEW EVENT

61

Contact Verisae

Log Out

Record New Event

63 Client: Albertson's

65 Site: 0107 - Fleming, ID

67 Site System: RTU-7

Identify the specific client, Site Location, and Site System which service was performed on.

73 Refrigerant Type: R-22

Indicate details of the service performed

75 Amount Added (lbs)

77 Amount Recovered (lbs)

69 Date of Service

71 Service Reference #

If refrigerant was recovered, account for it's disposition using the Action Codes below

| Fault Codes | Action Codes |
|---|---|
| 001 Preventive Maintenance | 003 No Recovery |
| 001 Preventive Maintenance | 001 Recovered to Store |
| 001 Preventive Maintenance | 001 Recovered to Store |

Identify the codes that most closely describe the reason(s) for the service performed (Faults) and what type(s) of servicing performed (Actions).

Technician: Anthony Peeler

Identify the technician who performed the servicing. Add any additional comments that may be needed to supplement the above information.

Technician Comments

Save Cancel

FIG. 6A

REFRIGERANT LOSS TRACKING AND REPAIR

CROSS-REFERENCE TO RELATED APPLICATION

This application claims priority from U.S. provisional application No. 60/432,120, filed Dec. 9, 2002, and is a continuation-in-part of U.S. patent application Ser. No. 09/883,779, filed on Jun. 18, 2001, which claims the benefit of U.S. Provisional Application No. 60/212,234, filed on Jun. 16, 2000, and U.S. Provisional Application No. 60/288,827, filed on May 5, 2001.

FIELD OF THE INVENTION

This invention relates generally to a system and method for tracking refrigerant loss and repairing commercial HVAC and refrigeration systems. More specifically, it relates to system for complying with the EPA's regulations governing equipment using ozone depleting refrigerants.

BACKGROUND OF THE INVENTION

In Section 608 of Title IV of the Clean Air Act Amendments of 1990, Congress called for the Environmental Protection Agency ("EPA") to promulgate regulations regarding the use, recycling, and disposal of ozone-depleting substances. Included in these ozone-depleting substances are industrial process and commercial refrigeration systems. Pursuant to this statutory mandate, the EPA enacted a series of regulations, which are summarized in a document that it prepared in conjunction with the Chemical Manufacturers Association, entitled "Compliance Guidance for Industrial Process Refrigeration Leak Repair Regulations Under Section 608 of the Clean Air Act," dated October 1995, which is incorporated herein by reference in its entirety. A copy of this document is attached hereto as Attachment "A."

Recently, the EPA has levied several significant fines for failure to comply with these Section 608 regulations regarding class I or class II refrigerants. Class I refrigerants are generally chlorofluorocarbon ("CFC") refrigerants or any refrigerant mixture containing a CFC. Class II refrigerants are hydrochlorofluorocarbon ("HCFC") refrigerants or any refrigerant mixture containing an HCFC. The regulations require, among other provisions, that owners or operators of commercial refrigeration systems track refrigerant leaks, repair the equipment using certified technicians, and retrofit or retire systems exceeding a certain leak threshold. The regulations also require an appropriate record keeping of these activities surrounding the refrigeration systems.

FIG. 1 is a flowchart illustrating the regulations 10 promulgated by the EPA relating to refrigerant loss in refrigeration systems. As shown in FIG. 1, the first step is to determine whether a particular refrigeration system or piece of refrigeration equipment is subject to the regulations (block 12). If so, the owner must track refrigerant loss in the system and calculate whether the amount of leakage crosses a predetermined action threshold (block 14). If the amount of loss exceeds the threshold, the owner must decide whether to repair, retrofit, or retire the refrigeration system (block 16). If the owner decides to repair the system, it must follow the repair requirements (block 18), and if the owner decides to retrofit or retire the system, it must follow those requirements (block 19). As shown in FIG. 1, both approaches present significant compliance requirements and challenges to the owner of the refrigeration system. These challenges are multiplied in the cases where the owner is a distributed enterprise having numerous refrigeration systems at distributed locations.

Accordingly, there is a need in the art for a system or method for tracking refrigerant loss in equipment subject to the EPA regulations and ensuring compliance with those regulations. There is a further need for a system for complying with the extensive requirements relating to repair, retrofit, or retirement of refrigeration systems.

BRIEF SUMMARY OF THE INVENTION

The present invention, in one embodiment, is a network-based equipment management system. The system includes first database including a plurality of characteristics relating to a piece of equipment located at a site. The system also includes a server including software for tracking a refrigerant characteristic of the piece of equipment. The server also includes further software to generate a notification relating to the refrigerant characteristic.

In another embodiment, the present invention is a method of equipment management. The method includes maintaining at a first database a plurality of characteristics relating to a piece of equipment located at a site. The method further includes tracking with software a refrigerant characteristic of the piece of equipment based on the plurality of characteristics, the software being in a server. The method also includes generating at the server a notification relating to the refrigerant characteristic.

While multiple embodiments are disclosed, still other embodiments of the present invention will become apparent to those skilled in the art from the following detailed description. As will be apparent, the invention is capable of modifications in various obvious aspects, all without departing from the spirit and scope of the present invention. Accordingly, the drawings and detailed description are to be regarded as illustrative in nature and not restrictive.

BRIEF DESCRIPTION OF THE DRAWINGS

FIG. 6A shows a sample user interface for entering service details, according to one embodiment of the present invention.

DETAILED DESCRIPTION

Figure 1:
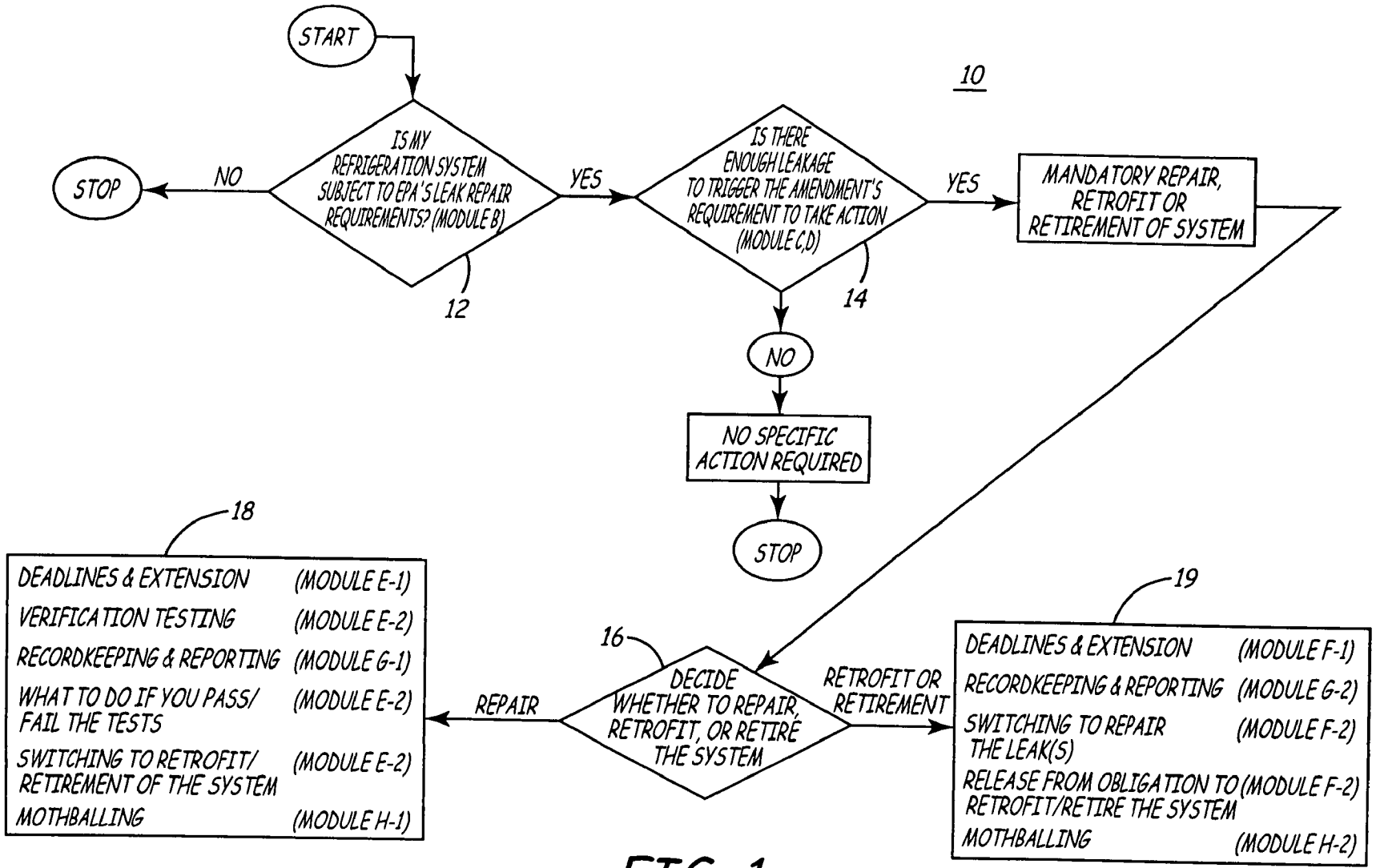
FIG. 1 is a flow chart illustrating the regulations promulgated by the EPA relating to refrigerant loss in refrigeration systems.
Figure 2:
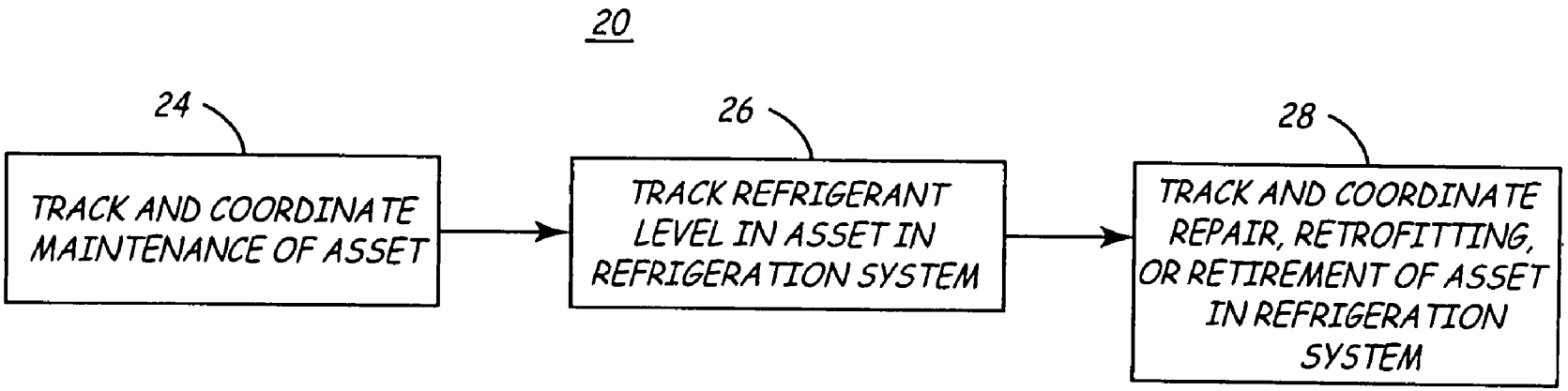
FIG. 2 is a flow chart illustrating the operation of an asset management system, according to one embodiment of the present invention.

FIG. 2 is a flow chart depicting the operation of an asset management system 20, according to one embodiment of the present invention. The system 20 tracks and coordinates maintenance and repair of an asset (block 24). In one embodiment, the asset is part of a refrigeration system, and the system 20 of the present invention tracks the refrigerant level in the refrigeration equipment (block 26). In a further embodiment, the system 20 tracks and coordinates repair, retrofitting, or retirement of the asset in the refrigeration system (block 28).

Figure 3:
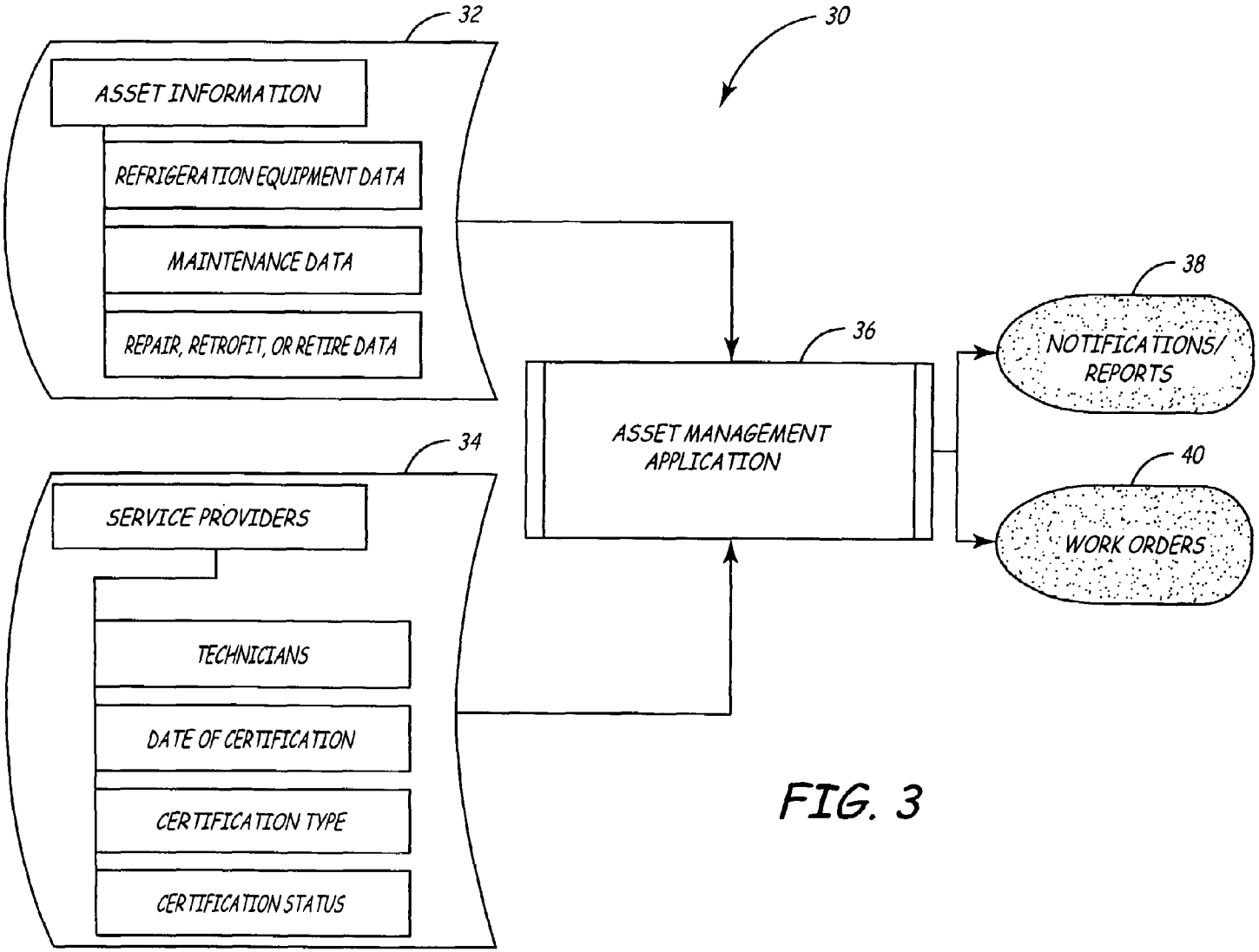
FIG. 3 is a block diagram showing the inputs and outputs of a refrigerant tracking solution, according to one embodiment of the present invention.

FIG. 3 is a block diagram showing the input and outputs of an asset management system 30, according to one embodiment of the present invention. As shown in FIG. 2, the system 30 includes an equipment (or "asset") database 32, which includes information for each piece of equipment being tracked, and a service provider database 34, which includes information of various service providers. A service provider may be an entity. Alternatively, the service provider may be an individual. According to one embodiment, the equipment being tracked is a refrigeration system or circuit. The equipment database 32 and the provider database 34 serve as the inputs to the asset management application 36, which generates notifications 38 to an owner or operator of the asset and work orders 40 to an appropriate service provider.

The asset database 32 includes general asset information relating to all the client's assets and maintenance information for each asset. The asset information may include site information relating to all sites where the client has assets, including site location, identification of assets at the site, and other relevant site information. The asset information may also include manufacturer information, supplier information, warranty information, and any other relevant information for each asset. If the asset is one part of a system comprised of more than one asset, the asset information may include system information, including the system name, description of the system, identification of the assets in the system, system status, along with any other relevant information. The system status options may include, without limitation, normal operation, provisional operation, under repair, or being retrofitted.

According to one embodiment, if the asset is a piece of refrigeration equipment, the asset database 32 includes refrigeration equipment information and repair, retrofit, or retirement information. The refrigeration equipment information may include identification of the type of refrigeration equipment. For example, the asset may be HVAC equipment. The refrigeration equipment information may also include an EPA category, certification type required of the service provider by the EPA, the amount of refrigerant when the asset is fully charged, the refrigerant charge determination method, the refrigerant type, the refrigerant circuit the equipment is associated with, all past work orders (including the amount of refrigerant used) that have been performed on the system, or any assets attached to the system, such as refrigerated cases or HVAC systems, and any other relevant information. Some options for the refrigerant charge determination method may include measurement, calculation, manufacturer's information, or establish range. Examples of refrigerant type include R-22, $^{12}/_{152}$a blend, $^{22}/_{115}$ blend, and 401A (MP39). Further, the database 32 can include any additional information known to be useful in asset management.

The service provider database 34 includes general service provider information and certification information for each service provider available to service an asset. The service provider information may include the name of the service provider, a description, an address, a phone number, a mobile phone number, a fax number, an e-mail address, a username and password to log onto the system of the present invention, technician names, and any other relevant information. The certification information may include a qualification type, a certificate number, an expiration date for the certificate, a status, and any other relevant information. According to one embodiment, the certification information is associated with technicians.

Figure 4:
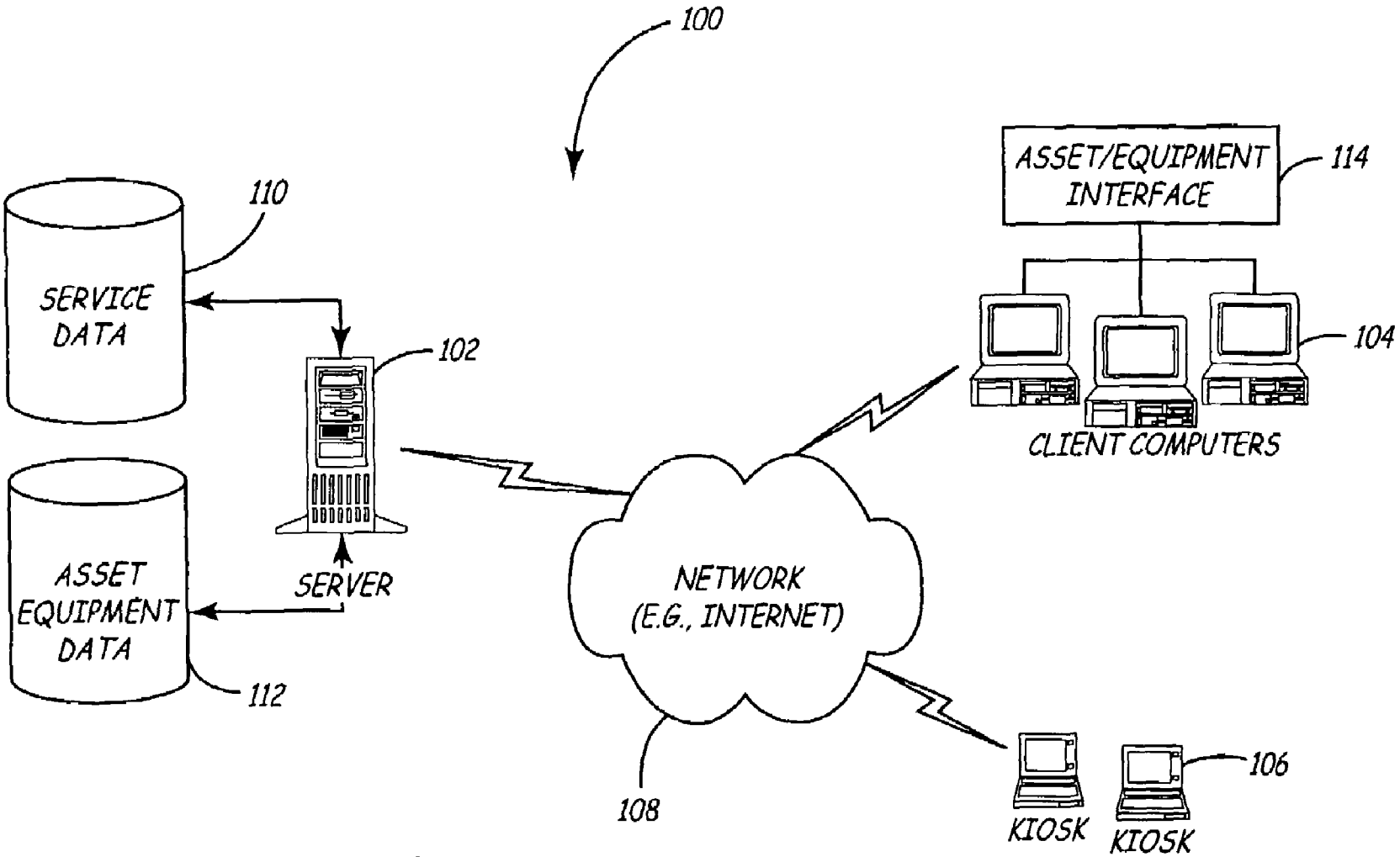
FIG. 4 is a block diagram depicting an asset management system, according to one embodiment of the present invention.

In an alternative embodiment, the system of the present invention is implemented in conjunction with a network-based enterprise asset management system for managing the assets of a distributed enterprise. One example of such a system is disclosed in co-pending U.S. patent application Ser. No. 09/883,779, entitled "Method and System for Managing Enterprise Assets," filed on Jun. 18, 2001, which is incorporated herein by reference in its entirety. FIG. 4 is a schematic diagram showing a network-based refrigerant tracking system 100 according to a second embodiment of the present invention. As shown in FIG. 4 the system 100 includes a server 102 in communication with client computers 104 and kiosks 106 through a network 108. As further shown, in one embodiment, the server 102 is in communication with a service database 110 and an asset or equipment database 112. The client computers 104 are in communication with individual pieces of equipment through an asset/equipment interface 114. In the system 100, the client computers receive information from refrigeration equipment, which is part of an overall refrigeration system, through the interface 114. This information is then used in the manner described below and may be stored in the equipment database 112.

Figure 5A:
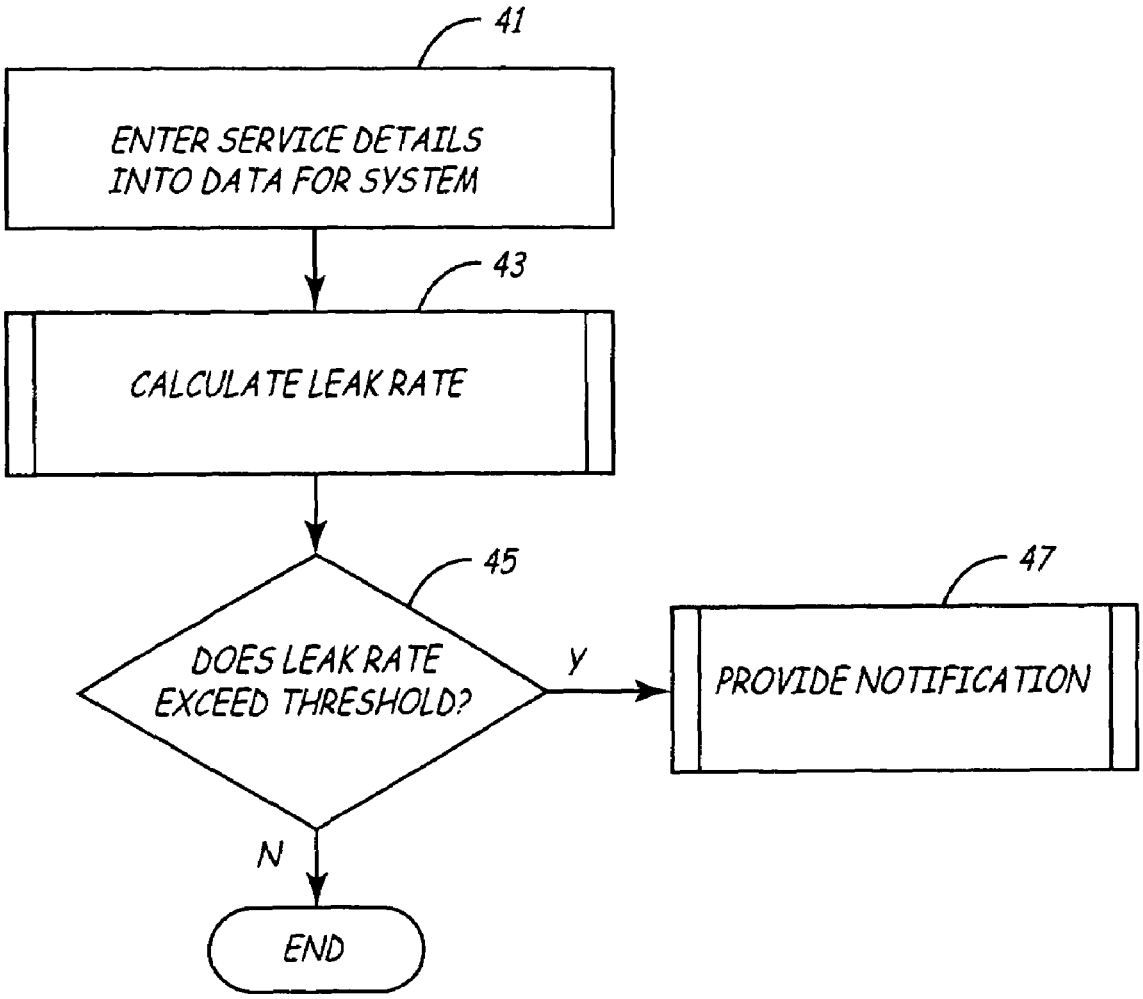
FIG. 5A is a flow chart illustrating the tracking of refrigerant characteristics, according to one embodiment of the present invention.

FIG. 5A is a flow chart illustrating the tracking of the refrigerant level 6, according to one embodiment of the present invention. Each time routine periodic maintenance or equipment repair or any other type of service is performed on a piece of equipment, the service provider is required to provide some basic information for the asset information database 32. In one embodiment, this information is entered as explained below, with reference to FIGS. 6 and 6A. As shown in FIG. 5A, after a technician at a service provider has serviced a piece of equipment, the details of the service are recorded (e.g., entered into a database) and associated with the piece of equipment repaired (block 41). According to one embodiment, the system of the present invention saves all such service details in a database such that the system accumulates all service event history. A leak rate for the refrigeration system (which may include other components) is then calculated (block 54) by the asset management application 36. According to one embodiment, the leak rate is calculated based on the refrigerant information included in the details of the service and the refrigerant information from the most recent prior service. For example, the percentage leak rate is calculated (block 54) using the following calculation:

$$\left[\frac{\left[\frac{\text{[lbs. of refrigerant added]}}{\text{[lbs. of refrigerant in full charge]}}\right]}{\left[\frac{\text{[days since refrigerant last added]}}{\text{[365 days]}}\right]}\right]\times 100$$

According to one embodiment, the system of the present invention performs the calculation using information in the asset database, including pounds of refrigerant in a full charge and days since refrigerant last added. Alternatively, the system of the present invention calculates the leak rate for a piece of equipment for any desired time period based on more than one service event. In a further alternative, the system calculates the leak rate for an entire system, an entire site, or an entire enterprise (comprised of more than one site).

Alternatively, data is collected for the equipment database 32 with a survey tool. In a further alternative, data is collected for any database in the system with a survey tool. One example of such a tool is disclosed in co-pending U.S. patent application Ser. No. 60/444,437, entitled "Site Equipment Survey Tool," filed on Feb. 3, 2003, which is incorporated herein by reference in its entirety.

Figure 5B:
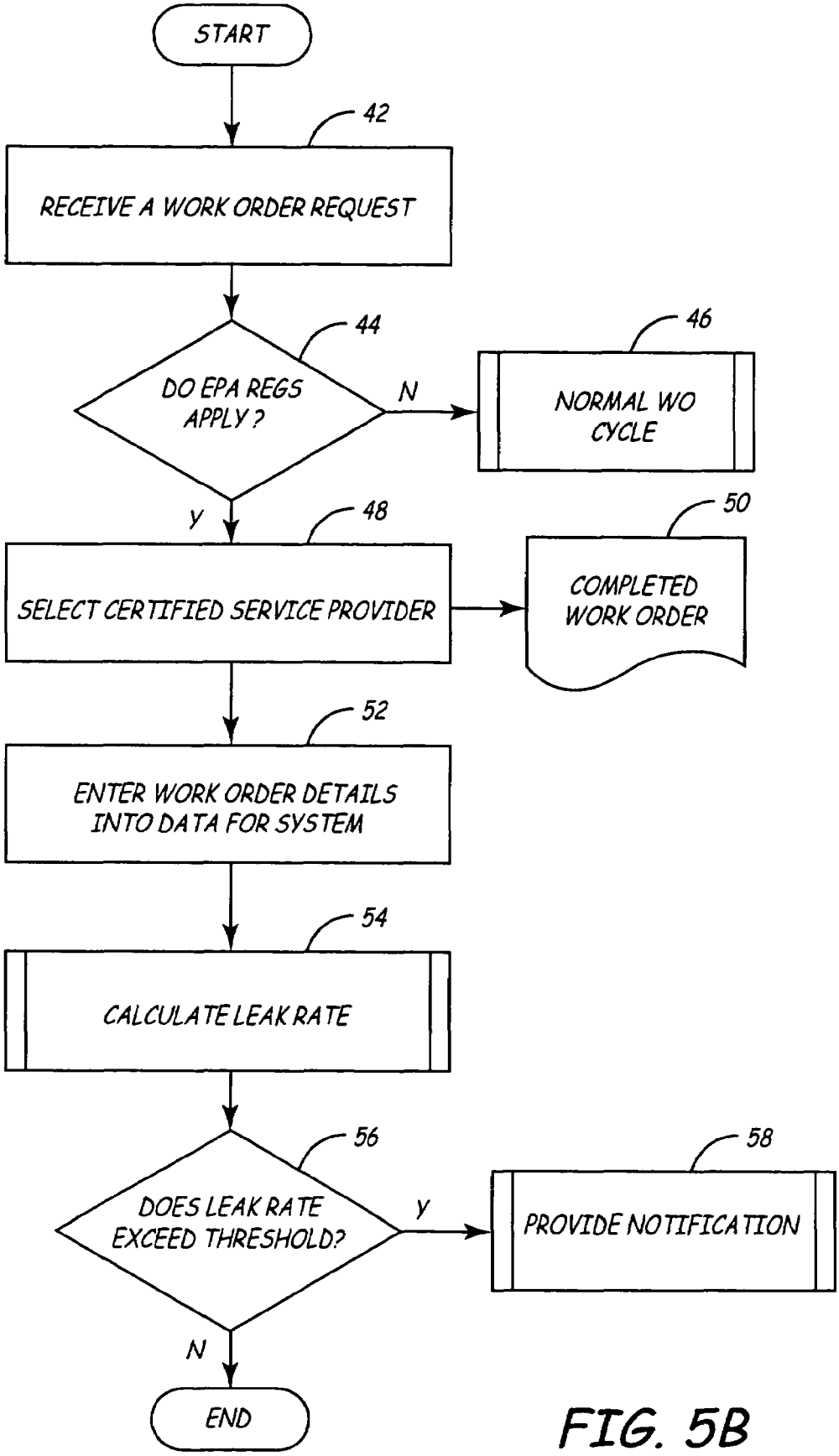
FIG. 5B is a flow chart illustrating the tracking of refrigerant characteristics, according to a second embodiment of the present invention.

FIG. 5B is a flow chart illustrating the tracking of the refrigerant level 6, according to a second embodiment of the present invention. As shown in FIG. 5B, this process includes receiving a work order for a malfunctioning or leaking piece of refrigeration equipment (block 42) and deciding whether the equipment is subject to the EPA regulations relating to ozone-depleting substances (block 44). If the equipment is not subject to the regulations, it is processed according to normal repair procedures. In one embodiment, for example, a work order is generated for its repair using standard procedures (block 46). According to one embodiment, once a service request is processed by the central processor, a service provider is determined automatically by determining which service provider is linked to the particular asset and a particular geographic location, and the service provider is notified automatically via an E-mail message or other form of electronic messaging. If the service provider does not respond to an E-mail within a specified period of time, additional E-mails may be sent automatically. The E-mail can include the type of asset requiring service, the reported failure, location, contact person, and prior service history of the asset. In addition, the service provider may also obtain additional information on the asset by accessing the central processor via the internet or a kiosk.

If the equipment is subject to the regulations and based on the client, the site (i.e., location), and the particular piece of equipment, a certified service provider is selected (block 48) who completes the necessary repairs to the equipment and refills the refrigerant if necessary. In one embodiment, the service provider then completes an associated work order (block 50). The details of the repair are then recorded (e.g., entered into a database) and associated with the piece of equipment repaired (block 52). A leak rate for the refrigeration system (which may include other components) is then calculated (block 54) as described herein.

Figure 5C:
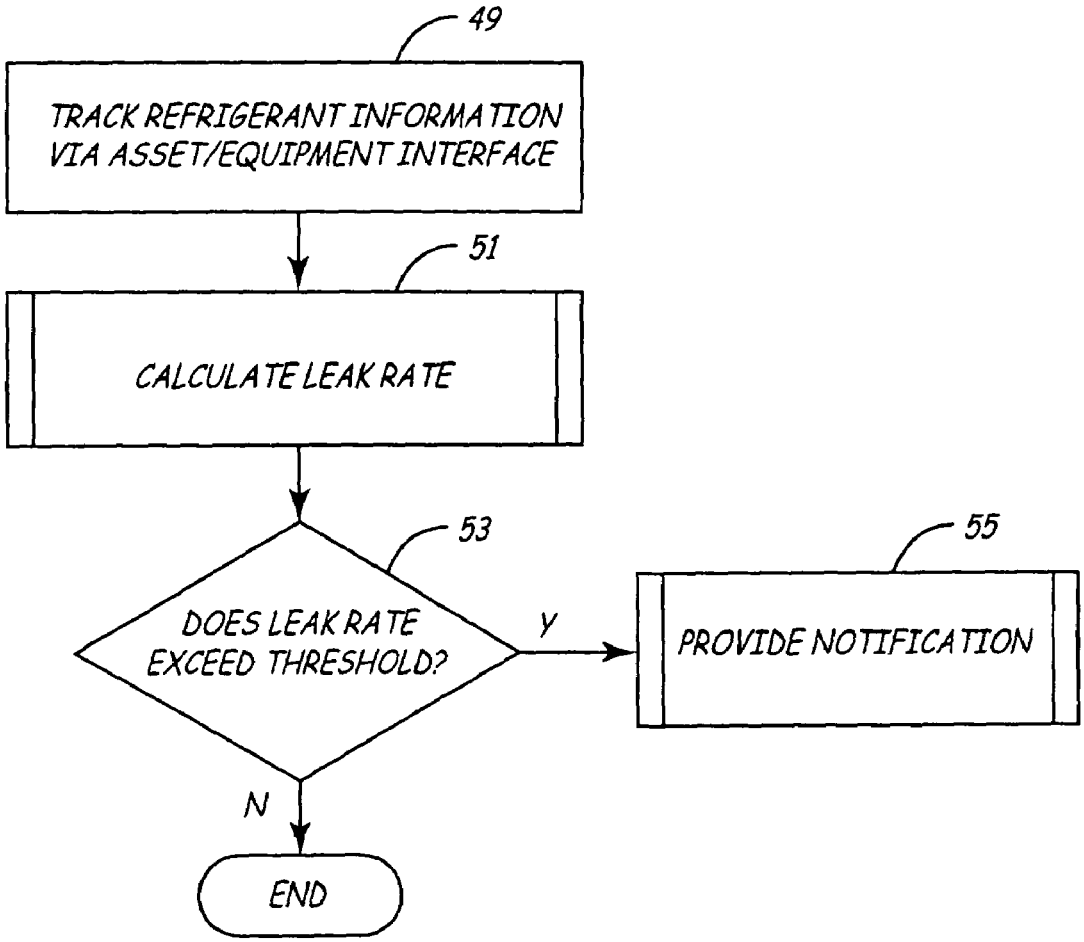
FIG. 5C is a flow chart illustrating the tracking of refrigerant characteristics, according to a third embodiment of the present invention.

FIG. 5C is a flow chart illustrating the tracking of the refrigerant level 6 using a network-based enterprise asset management system with an asset/equipment interface 114, according to a third embodiment of the present invention. The asset/equipment interface 114 allows the system to automatically track any operating information relating to each asset without manual input by a user. As shown in FIG. 5C, the system tracks refrigerant information via an asset/equipment interface (block 49). According to one embodiment, tracking refrigerant information includes receiving the refrigerant information at the client computers 104 via the asset/equipment interface 114 and then saving that information into the asset/equipment database 112. A leak rate for the refrigeration system (which may include other components) is then calculated (block 51) by the asset management application 100. The leak rate is calculated by software present on the server 102 based on the refrigerant information continuously collected through the asset/equipment interface 114 and saved to the asset/equipment database 112. If the calculated leak rate exceeds the threshold level established by the EPA (block 53), the system provides a notification 55 to the appropriate users (block 55).

According to one embodiment, the system 100 receives information from the asset using a notification system. One example of such a system is disclosed in co-pending U.S. patent application Ser. No. 60/433,179, entitled "Notification System," filed on Dec. 13, 2002, which is incorporated herein by reference in its entirety.

Figure 6:
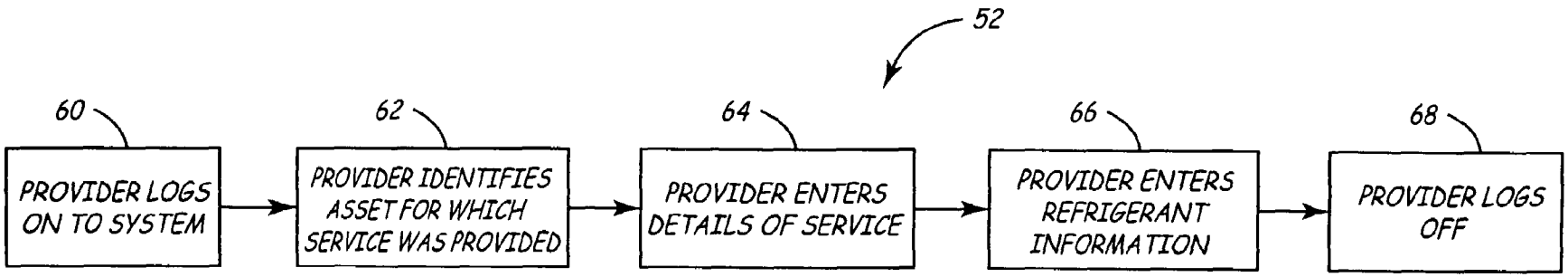
FIG. 6 is a flow chart depicting the entering of work order details (or service details), according to one embodiment of the present invention.

FIG. 6 is a flow chart depicting the entering of work order or service details 52 according to one embodiment. A user associated with the service provider (or simply "provider") logs onto the system of the present invention (block 60). Alternatively, any other authorized user logs onto the system. According to one embodiment, the system provides to the provider a range of information relevant to the provider when the provider logs on. For example, the system may provide service provider information and asset information relating to the equipment the provider has serviced in the past. The provider then identifies the asset that was serviced (block 62). The details of the service are then entered (block 64). As shown in FIG. 6A, which shows an exemplary user interface 61, the service details may include the name of the asset owner (or "client") 63, the site where the asset is located 65, the system that the asset is a part of 67, a description of the service, the date of the service 69, a service reference number 71, and any other relevant information. The refrigerant information is also entered (block 66). According to one embodiment, the refrigerant information includes the refrigerant type 73, the amount added 75, the amount recovered 77, and any other relevant information. The provider then logs off (block 68).

To limit access to authorized users, in one embodiment, the subject invention allows for various types of users and users at various distributed sites to have distinct levels of access. For example an enterprise or store user, in one embodiment, has full access to all assets and all pending work orders pertaining to his or her store. A service provider user has access to all assets of a type that he services and all work orders that he is responsible for fulfilling. These assets may include assets located at various distributed sites and may even include assets owned by distinct enterprises. An equipment manufacturer may have access to the assets at the various distributed sites that it manufactured.

Levels of access can be controlled by specifying securable or configurable attributes for each system user. These attributes can be specified by a system administrator, who may be an enterprise asset management company or may be with the enterprise itself. In one embodiment, the securable attributes are pre-defined based on the type of user. For example, user can have access to assets based on hierarchical levels within an enterprise. If the user is a regional manager, he will have access to assets in all of the locations of his store within his region. If the user is manager of a particular location, access may be limited to assets within that particular location.

The user's level of access can also be defined by his assigned roles and rights. Like the user's securable attributes, the user's roles and rights may be pre-specified by using a type of user, such as a "store manager." Based on the user's type, he is given certain rights and roles. In one example, the rights that are granted or denied include the right to create new users (having access at the current user's level or below), the right to add or modify assets, and the right to submit work orders.

Returning to FIG. 5, if the leak rate for the system fails to exceed the threshold (block 56), no further action is taken. If, on the other hand, the leak rate for the system exceeds the threshold, an appropriate notification is given to the owner or operator of the system (block 58). The appropriate notification, according to one embodiment, is an e-mail notification. Alternatively, the notification is a telephonic notification. In a further alternative, the notification can be made by any known mode of communication. The providing of notification to the owner or client 58 can be modified to fit the needs of the client, according to one embodiment of the present invention. A notification may be provided when the leak rate exceeds the threshold established by the EPA for the asset in question. Alternatively, the notification may be provided when the leak rate exceeds a lower threshold. In a further alternative, the system of the present invention can be modified to provide regular reports to the client. According to one embodiment, the system can be modified by the client.

Figure 7:
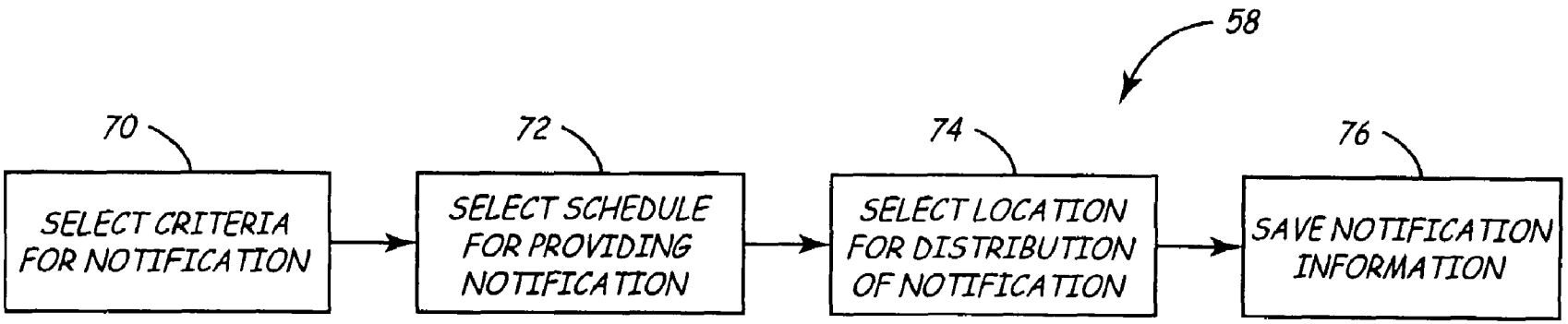
FIG. 7 is a flow chart illustrating the modification of the system to provide a notification, according to one embodiment of the present invention.

FIG. 7 is a flow chart depicting the modification of the system of the present invention to provide a notification 58, according to one embodiment of the present invention. First, criteria for the notification is selected (block 70). The criteria may include leak rate information, refrigerant usage information, service information, or other relevant information. According to one embodiment, the criteria is the amount of refrigerant added. Alternatively, the criteria is the number of service events related to refrigerant. In a further alternative, the criteria is the leak rate.

Figure 7A:
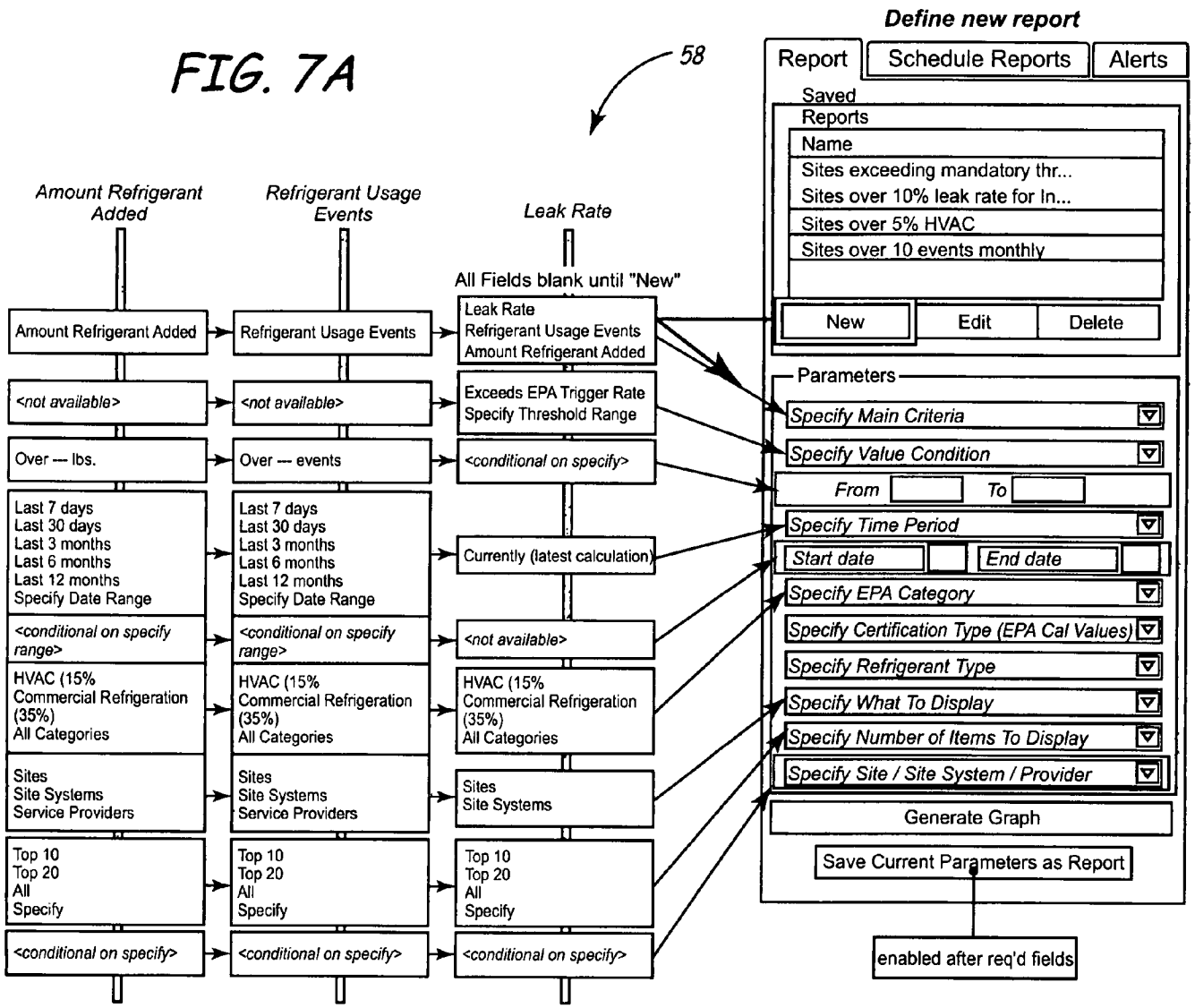
FIG. 7A shows a sample user interface for modifying the system to provide a notification, according to one embodiment of the present invention.

In one embodiment, a notification report is triggered when the calculated leak rate exceeds the maximum EPA guidelines. In other words, a notification is generated if the leak rate exceeds 35% for a refrigeration system and 15% for an HVAC system. In another embodiment, notification is generated when the leak rate reaches a specified percentage of the guideline leak rate. An exemplary user interface for allowing a system user to specify reports is shown in FIG. 7A.

The schedule for providing notification is then selected (block 72). According to one embodiment, the notification is a report that can be scheduled to be distributed on a routine basis, such as daily, weekly, or monthly. Alternatively, the report can be scheduled for a one-time distribution. In a further alternative, the notification is an alert that is scheduled to be distributed only upon the crossing of a predetermined threshold related to one of the criteria. For example, the alert may be sent when the leak rate for a particular asset or system reaches a predetermined amount, when the number of service events related to refrigerant in a particular asset or system reach a predetermined number, or when the amount of refrigerant added to a particular asset or system reaches a predetermined amount.

A location for distribution of the notification is then selected (block 74). The location may be the e-mail addresses of one or more people. Alternatively, the location may be one or more telephone numbers. In a further alternative, the location is any known location for sending an electronic notification. Finally, the notification information is saved to the system of the present invention (block 76).

A further aspect of the present invention is a system for coordinating the repair of refrigeration equipment pursuant to the EPA Section 608 requirements. The guidelines allow for either repair or retrofit.

Figure 8:
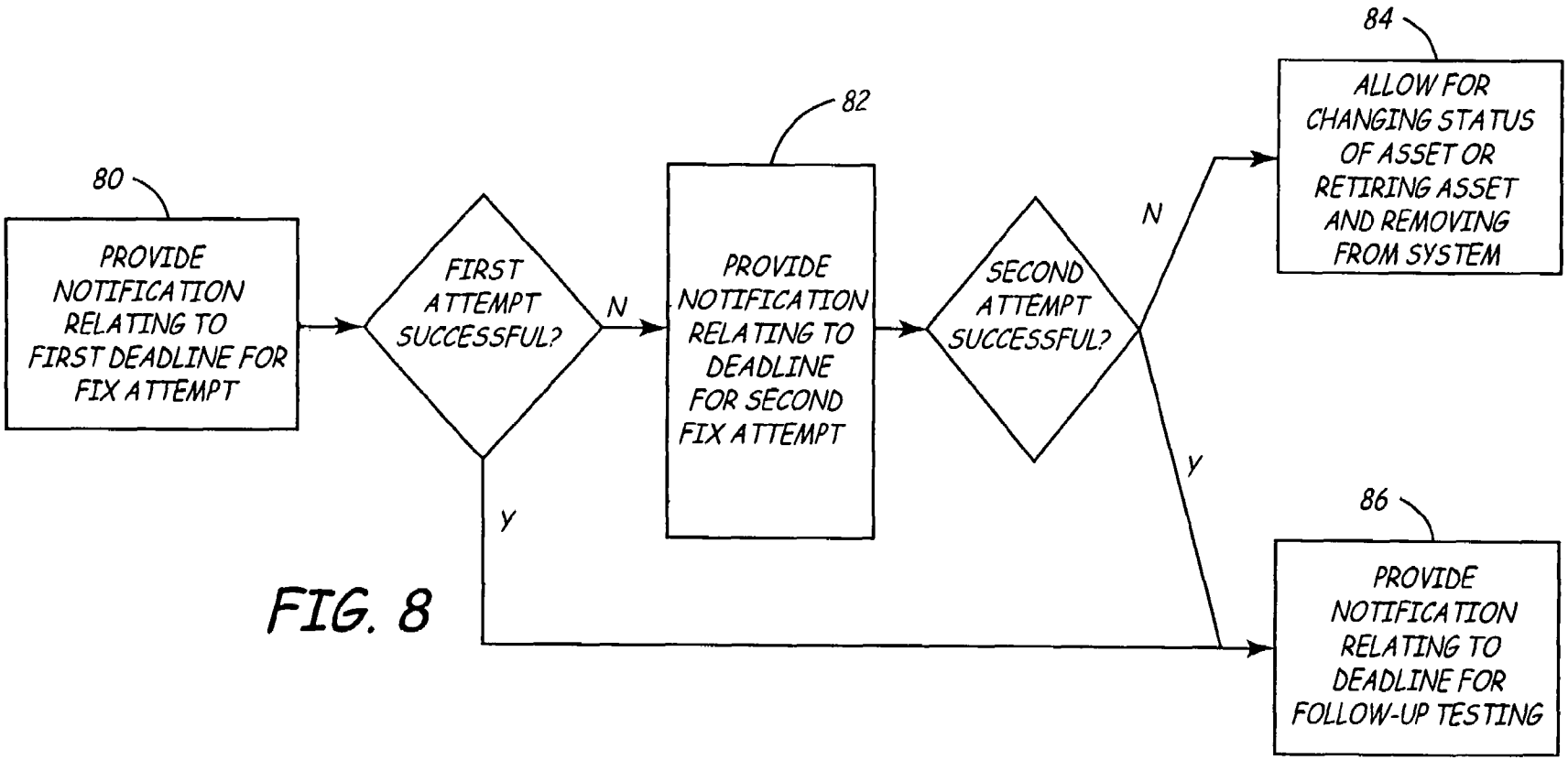
FIG. 8 is a flow chart depicting the tracking and coordinating of the repair of an asset, according to one embodiment of the present invention.

FIG. 8 is a flow chart depicting the tracking and coordinating of the repair of an asset according to one embodiment of the present invention. The system 30 provides notification relating to the first deadline for a fix attempt on the asset (block 80). According to one embodiment, the notification is a mandatory notification sent out on the date of the deadline. Alternatively, the system is modifiable to allow for a notification at some point prior to the date of the deadline. In a further alternative, the system provides for both a prior notification and the mandatory notification on the date of the deadline. In one embodiment, notification goes to a site manager who contacts a service provider. In another embodiment, the notification goes directly to the service provider. After the service provider completes the first repair attempt, the provider enters information about the repair into the system 30. In one embodiment, this information is entered using the user interface shown in FIG. 5A.

If the first fix attempt is unsuccessful, the system provides notification relating to the deadline for a second fix attempt (block 82). According to one embodiment, the notification is a mandatory notification sent out on the date of the deadline. Alternatively, the system is modifiable to allow for a notification at some point prior to the date of the deadline. In a further alternative, the system provides for both a prior notification and the mandatory notification on the date of the deadline.

If the first or second fix attempt is successful, the system allows for notification relating to the deadline for mandatory follow-up testing (block 86). According to one embodiment, the notification is a mandatory notification sent out on the date of the deadline. Alternatively, the system is modifiable to allow for a notification at some point prior to the date of the deadline. In a further alternative, the system provides for both a prior notification and the mandatory notification on the date of the deadline.

If the first and second fix attempts are unsuccessful, the system allows for changing the status of the asset or removing the asset from the system due to retirement (block 84). Alternatively, the system allows for further notifications relating to further fix attempts.

Figure 9:
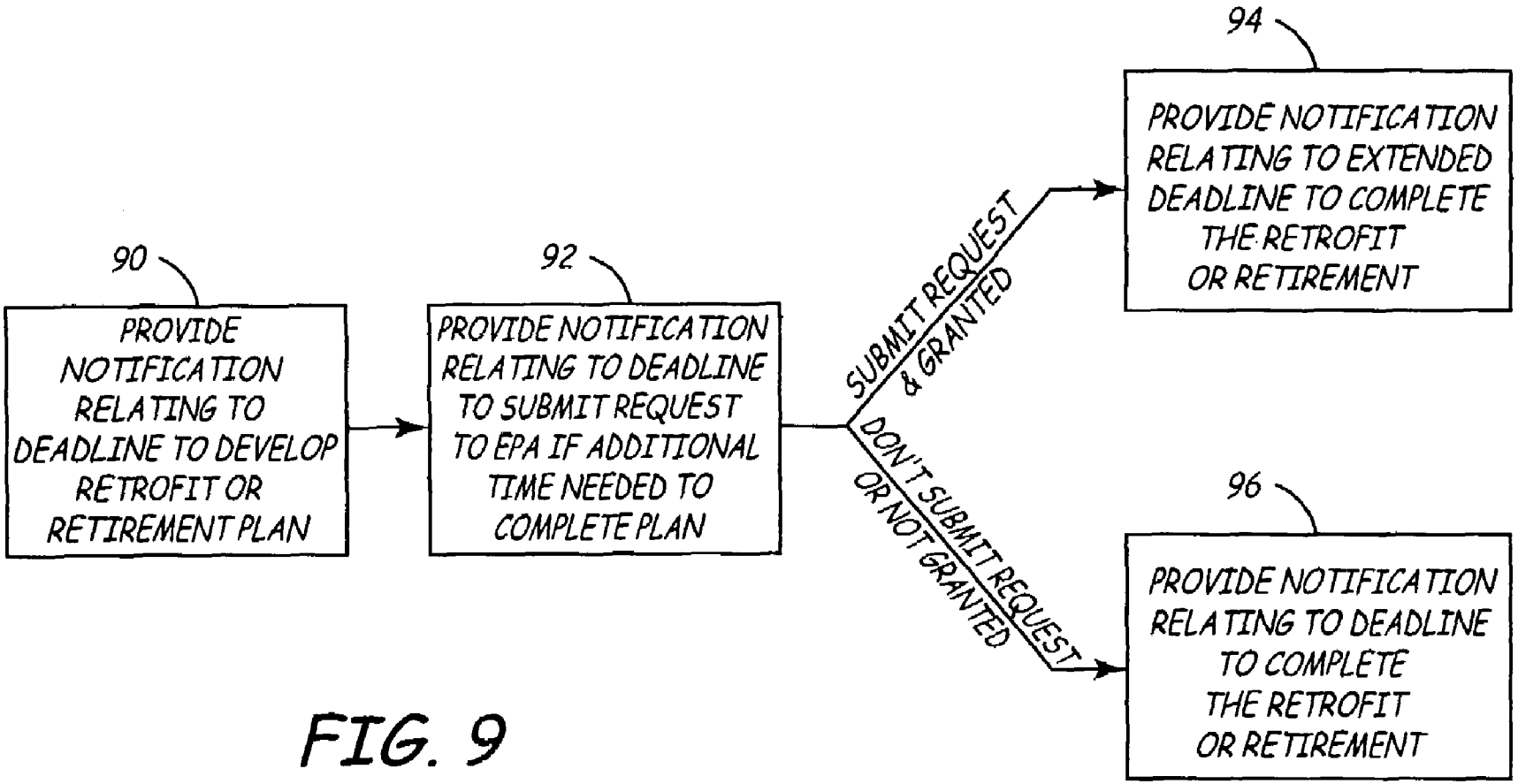
FIG. 9 is a flow chart depicting the tracking and coordinating of the retrofitting or retirement of an asset, according to one embodiment of the present invention.

FIG. 9 is a flow chart depicting the tracking and coordinating of the retrofitting or retirement of an asset 8 according to one embodiment of the present invention. The system provides notification relating to the deadline to develop a plan to retrofit or retire the asset (block 90). According to one embodiment, the notification is a mandatory notification sent out on the date of the deadline. Alternatively, the system is modifiable to allow for a notification at some point prior to the date of the deadline. In a further alternative, the system provides for both a prior notification and the mandatory notification on the date of the deadline.

The system further provides notification relating to the deadline to submit a request to the EPA for an extension of the deadline of additional time is needed to complete the plan (block 92). According to one embodiment, the notification is a mandatory notification sent out on the date of the deadline. Alternatively, the system is modifiable to allow for a notification at some point prior to the date of the deadline. In a further alternative, the system provides for both a prior notification and the mandatory notification on the date of the deadline.

If a request for an extension is granted, the system allows for notification relating to the extended deadline to complete the retrofit or retirement of the asset (block 94). According to one embodiment, the notification is a mandatory notification sent out on the date of the extended deadline. Alternatively, the system is modifiable to allow for a notification at some point prior to the date of the extended deadline. In a further alternative, the system provides for both a prior notification and the mandatory notification on the date of the extended deadline.

If no request for an extension is submitted or the request is not granted, the system allows for providing notification relating to the deadline to complete the retrofit or retirement of the asset (block 96). Alternatively, the system allows for additional notifications as additional deadlines are added during the retrofit or retirement process.

In an alternative embodiment, the system 30 prompts for the required inputs and generates a customized plan for repair/retirement/retrofit, based on responses from the user. In one alternative embodiment, the system 30 recommends a repair or retrofit plan, based on the responses from the user. In another embodiment, a standard plan is generated and communicated to the user. In a further embodiment, all documents and instructions associated with the plan are stored on one of the databases to facilitate dissemination to all responsible parties as needed.

Although the present invention has been described with reference to preferred embodiments, persons skilled in the art will recognize that changes may be made in form and detail without departing from the spirit and scope of the invention.

What is claimed is:

1. A network-based equipment management system for managing a plurality of pieces of equipment located at a plurality of locations of an enterprise, the system comprising:

(a) a central processor accessible at the plurality of locations on a computer network;

(b) a database in communication with the central processor, the database configured to store:

(i) asset information relating to each of the plurality of pieces of equipment, wherein the information comprises at least a refrigerant level; and (ii) service provider information;

(c) tracking software associated with the central processor, the tracking software configured to track at least one of a refrigerant leak rate, refrigerant usage, and refrigerant service events of each of the plurality of pieces of equipment;

(d) notification software associated with the central processor, the notification software configured to generate a predetermined automatic notification, wherein the notification software is configured to allow a user to select the predetermined automatic notification based on the refrigerant leak rate or the refrigerant usages of any one of the plurality of pieces of equipment;

(e) identification software associated with the central processor, the identification software configured to automatically identify an appropriate service provider and an appropriate service technician for a particular piece of equipment based on the particular piece of equipment and the service provider information; and (f) a first predetermined limited user access level programmed into the central processor, wherein the first predetermined limited user access level is configured to restrict access of at least one first user to solely a first predetermined subset of the asset and service provider information based on a configurable user profile of the first user; and (g) a second predetermined limited user access level programmed into the central processor, wherein the second predetermined limited user access level is configured to restrict access of at least one second user to solely a second predetermined subset of the asset and service provider information based on a configurable user profile of the second user, wherein the second predetermined subset of the asset and service provider information is a smaller subset of information than the first predetermined subset of asset and service provider information.

2. The system of claim 1, further comprising leak rate calculation software associated with the central processor, the leak rate calculation software configured to calculate the refrigerant leak rate.

3. The system of claim 2, wherein the leak rate is expressed as the percent of full charge that would be lost per 12-month period, using the following equation:

$$\left[\left[\frac{[\text{lbs. of refrigerant added}]}{[\text{lbs. of refrigerant in full charge}]}\right]\frac{[\text{days since refrigerant last added}]}{[\text{365 days}]}\right]\times 100$$

4. The system of claim 1, wherein the identification software being configured to automatically identify the appropriate service provider further comprises the identification software being further configured to verify that the appropriate service provider is certified by the EPA.

5. The system of claim 1, wherein the information relating to each of the plurality of pieces of equipment further comprises a full charge capacity of at least one of the plurality of pieces of equipment, a refrigerant type of at least one of the plurality of pieces of equipment, and at least one prior work order of at least one of the plurality of pieces of equipment.

6. The system of claim 1, wherein the notification based on the refrigerant leak rate is based on the refrigerant leak rate exceeding a predetermined level.

7. The system of claim 1, wherein the notification software is further configured to allow the user to select the predetermined automatic notification based on a number of service events related to refrigerant.

8. The system of claim 1, wherein the notification software is further configured to distribute the predetermined automatic notification to the appropriate service provider.

9. The system of claim 1, further comprising a client processor in communication with the central processor, whereby the appropriate service provider can access information.

10. The system of claim 1, wherein (a) the first predetermined subset of the asset and service provider information comprises the asset and service provider information for predetermined sites; and (b) the second predetermined subset of the asset and service provider information comprises the asset information for particular types of assets at the predetermined sites.

11. The system of claim 1, wherein the database is further configured to store site information relating to each of the plurality of locations, the site information comprising at least site location and identification of assets at each site.

12. A network-based equipment management system for managing a plurality of pieces of equipment located at a plurality of locations of an enterprise, the system comprising:

(a) a central processor accessible at the plurality of locations on a computer network;

(b) a database in communication with the central processor, the database configured to store:

(i) asset information relating to each of the plurality of pieces of equipment, wherein the information comprises at least a refrigerant level; and (ii) service provider information;

(c) tracking software associated with the central processor, the tracking software configured to track a refrigerant leak rate of each of the plurality of pieces of equipment;

(d) identification software associated with the central processor, the identification software configured to automatically identify an appropriate service provider for a particular piece of equipment based on the particular piece of equipment and the service provider information;

(e) notification software associated with the central processor, the notification software configured to generate a notification based on the refrigerant leak rate of at least one of the plurality of pieces of equipment and distribute it to at least one predetermined location, wherein the notification software is configured to allow a user to select the predetermined location to be at least one of an e-mail address and a telephone number of at least one recipient; and (f) at least one predetermined limited user access level programmed into the central processor, wherein the at least one predetermined limited user access level is configured to restrict access of at least one user to solely a predetermined subset of the asset and service provider information based on a configurable user profile of the user, wherein the predetermined subset of the asset and service provider information is less than all of the asset and service provider information.

13. The system of claim 12, wherein the at least one recipient comprises at least the appropriate service provider.

14. The system of claim 12, further comprising a client processor in communication with the central processor, wherein the appropriate service provider can access information about the particular piece of equipment via the client processor.

15. The system of claim 12, wherein the identification software being configured to automatically identify the appropriate service provider further comprises the identification software being further configured to verify that the appropriate service provider is certified by the EPA.

16. The system of claim 12, wherein the predetermined subset of the asset and service provider information comprises the asset and service provider information for predetermined sites.

17. The system of claim 12, wherein the predetermined subset of the asset and service provider information comprises the asset information for particular types of assets.

18. A network-based equipment management system for managing a plurality of pieces of equipment located at a plurality of locations of an enterprise, the system comprising:

(a) a central processor accessible at the plurality of locations on a computer network;

(b) a database in communication with the central processor, the database configured to store:

(i) asset information relating to each of the plurality of pieces of equipment, wherein the information comprises at least a refrigerant level; and (ii) service provider information;

(c) at least one asset interface coupled to at least one of the plurality of pieces of equipment, wherein the asset interface is in communication with the central processor, wherein the asset interface is configured to automatically receive information relating to the one of the plurality of pieces of equipment, including the refrigerant level;

(d) tracking software associated with the central processor, the tracking software configured to track a refrigerant leak rate of any of the plurality of pieces of equipment, wherein the information relating to the plurality of pieces of equipment is received via either the at least one asset interface or a client processor;

(e) identification software associated with the central processor, the identification software configured to automatically identify an appropriate service provider for a piece of equipment experiencing a refrigerant leakage based on the piece of equipment experiencing the refrigerant leakage and the service provider information;

(f) notification software associated with the central processor, the notification software configured to generate a notification and distribute it to at least the appropriate service provider; and (g) at least one predetermined limited user access level programmed into the central processor, wherein the at least one predetermined limited user access level is configured to restrict access of at least one user to solely a predetermined subset of the asset and service provider information based on a configurable user profile of the user, wherein the predetermined subset of the asset and service provider information is less than all of the asset and service provider information.

19. The system of claim 18, further comprising repair/retirement/retrofit coordination software associated with the central processor, the repair/retirement/retrofit coordination software configured to generate prompts for a user and further to generate a customized repair/retirement/retrofit plan based on input provided by the user, wherein the repair/retirement/retrofit coordination software is configured to generate a repair plan comprising:

(a) distributing a first notification regarding a first deadline for a first service attempt of a piece of equipment requiring service; and (b) if the first service attempt is unsuccessful, distributing a second notification regarding a second deadline for a second service attempt of the piece of equipment requiring service.

20. The system of claim 19, wherein if the second service attempt is successful, the repair/retirement/retrofit coordination software is further configured to distribute a notification regarding a testing deadline.

21. The system of claim 19, wherein if the second service attempt is unsuccessful, the repair/retirement/retrofit coordination software is further configured to distribute a third notification regarding a third deadline for a third service attempt of the piece of equipment requiring service.

22. The system of claim 18, wherein the identification software being configured to automatically identify the appropriate service provider further comprises the identification software being configured to verify that the appropriate service provider is certified by the EPA.

23. The system of claim 18, wherein the client processor is in communication with the central processor, whereby the appropriate service provider can access information about the particular piece of equipment.

24. The system of claim 18, wherein the predetermined subset of the asset and service provider information comprises the asset and service provider information for predetermined sites.

* * * * *

UNITED STATES PATENT AND TRADEMARK OFFICE

CERTIFICATE OF CORRECTION

PATENT NO. : 7,512,523 B2
APPLICATION NO. : 10/429619
DATED : March 31, 2009
INVENTOR(S) : Daniel T. Johnson et al.

It is certified that error appears in the above-identified patent and that said Letters Patent is hereby corrected as shown below:

Cover Page, Related U.S. Application Data
Add the following provisional applications nos.:
--Provisional application No. 60/288,827, filed on May 5, 2001--
--Provisional application No. 60/212,234, filed on June 16, 2000--

Column 9
Line 51, Claim 1: Replace "usages" with --usage--

Signed and Sealed this

Twenty-second Day of September, 2009

David J. Kappos

David J. Kappos
*Director of the United States Patent and Trademark Office*